US011560891B2

(12) United States Patent
Tanaka

(10) Patent No.: US 11,560,891 B2
(45) Date of Patent: Jan. 24, 2023

(54) ELECTRIC HYDRAULIC ACTUATOR

(71) Applicant: KYB Corporation, Tokyo (JP)

(72) Inventor: Daisuke Tanaka, Gifu (JP)

(73) Assignee: KYB CORPORATION, Tokyo (JP)

( * ) Notice: Subject to any disclaimer, the term of this patent is extended or adjusted under 35 U.S.C. 154(b) by 136 days.

(21) Appl. No.: 16/767,865

(22) PCT Filed: Dec. 13, 2018

(86) PCT No.: PCT/JP2018/045908
§ 371 (c)(1),
(2) Date: May 28, 2020

(87) PCT Pub. No.: WO2019/131178
PCT Pub. Date: Jul. 4, 2019

(65) Prior Publication Data

US 2020/0370550 A1 Nov. 26, 2020

(30) Foreign Application Priority Data

Dec. 27, 2017 (JP) ..... JP2017-252041

(51) Int. Cl.
*F04C 2/18* (2006.01)
*F04C 15/00* (2006.01)
*F04C 2/14* (2006.01)

(52) U.S. Cl.
CPC ..... *F04C 2/18* (2013.01); *F04C 2/14* (2013.01); *F04C 15/0003* (2013.01);
(Continued)

(58) Field of Classification Search
CPC .... F04C 2/04; F04C 2/084; F04C 2/14; F04C 2/18; F04C 15/0003; F04C 15/0007;
(Continued)

(56) References Cited

U.S. PATENT DOCUMENTS 6,287,090 B1 * 9/2001 Hamasaki ..... F01C 21/10 417/360
2005/0196301 A1 * 9/2005 Iwasaki ..... F04C 2/086 417/410.4

(Continued)

FOREIGN PATENT DOCUMENTS

JP H10288168 A 10/1998
JP 2006-183592 A 7/2006

*Primary Examiner* — Kenneth J Hansen
(74) *Attorney, Agent, or Firm* — Rabin & Berdo, P.C.

(57) ABSTRACT

An electric hydraulic actuator is provided with an electric motor and a gear pump driven in rotation by the electric motor. The electric motor includes a motor housing and a rotating shaft supported by the motor housing so as to be freely rotatable. The gear pump has a drive gear into which the rotating shaft of the electric motor is inserted and a driven gear meshed with the drive gear. A pump housing is configured to accommodate the drive gear and the driven gear on one end and has an installation concave portion open at the other end for accommodating part of the motor housing. The motor housing is attached to the pump housing with a gap formed between the motor housing and the pump housing in a radial direction of the rotating shaft. The gap includes an O-ring to elastically support the motor housing in the radial direction.

10 Claims, 7 Drawing Sheets

(52) U.S. Cl.
CPC ..... *F04C 15/008* (2013.01); *F04C 15/0034* (2013.01); *F04C 15/0061* (2013.01); *F04C 2240/30* (2013.01)

(58) Field of Classification Search
CPC ..... F04C 15/0015; F04C 15/0034; F04C 15/0061; F04C 15/008; F04C 2240/30; F04B 17/03; F04D 29/12; F04D 29/106
See application file for complete search history.

(56) References Cited

U.S. PATENT DOCUMENTS

| | | | | |
|---|---|---|---|---|
| 2006/0120908 | A1* | 6/2006 | Ohnishi | F04C 11/001 418/61.3 |
| 2006/0168956 | A1* | 8/2006 | Sakai | F15B 1/26 60/473 |
| 2011/0223050 | A1* | 9/2011 | Park | F04C 2/3446 418/104 |
| 2016/0108914 | A1 | 4/2016 | Ramadoss et al. | |

* cited by examiner

ELECTRIC HYDRAULIC ACTUATOR

TECHNICAL FIELD

The present invention relates to an electric hydraulic actuator.

BACKGROUND ART

JP2006-183592A discloses a hydraulic drive unit provided with an external gear pump, which includes a driven gear and a drive gear that are meshed with each other, and an electric motor that drives the external gear pump.

SUMMARY OF INVENTION

With the electric hydraulic actuator as disclosed in JP2006-183592A, in order to achieve reduction in size and cost, it is conceivable to directly transmit rotation of a rotating shaft of an electric motor to the drive gear of the gear pump without using a coupling, etc.

In a case in which the rotation of the rotating shaft is directly transmitted to the drive gear, it is desired to improve a mechanical efficiency by suppressing misalignment by accurately performing positional alignment between the rotating shaft and the drive gear in the radial direction.

An object of the present invention is to improve a mechanical efficiency of an electric hydraulic actuator.

According to one aspect of the present invention, an electric hydraulic actuator includes: an electric motor configured to be rotated by a power supply; a gear pump configured to be driven by rotation of the electric motor; and an actuator configured to be extended/contracted by pressure of working fluid supplied by the gear pump. The electric motor has a motor housing and a rotating shaft supported by the motor housing so as to be freely rotatable. The gear pump has: a drive gear into which the rotating shaft of the electric motor is inserted, the drive gear being configured so as to be rotated together with rotation of the rotating shaft; a driven gear meshed with the drive gear; and a pump housing configured to accommodate the drive gear and the driven gear, and the motor housing of the electric motor is attached to the pump housing such that a gap is formed between the motor housing and the pump housing in a radial direction of the rotating shaft.

DESCRIPTION OF EMBODIMENTS

Embodiments of the present invention will be described below with reference to the attached drawings.

First Embodiment

Figure 1:
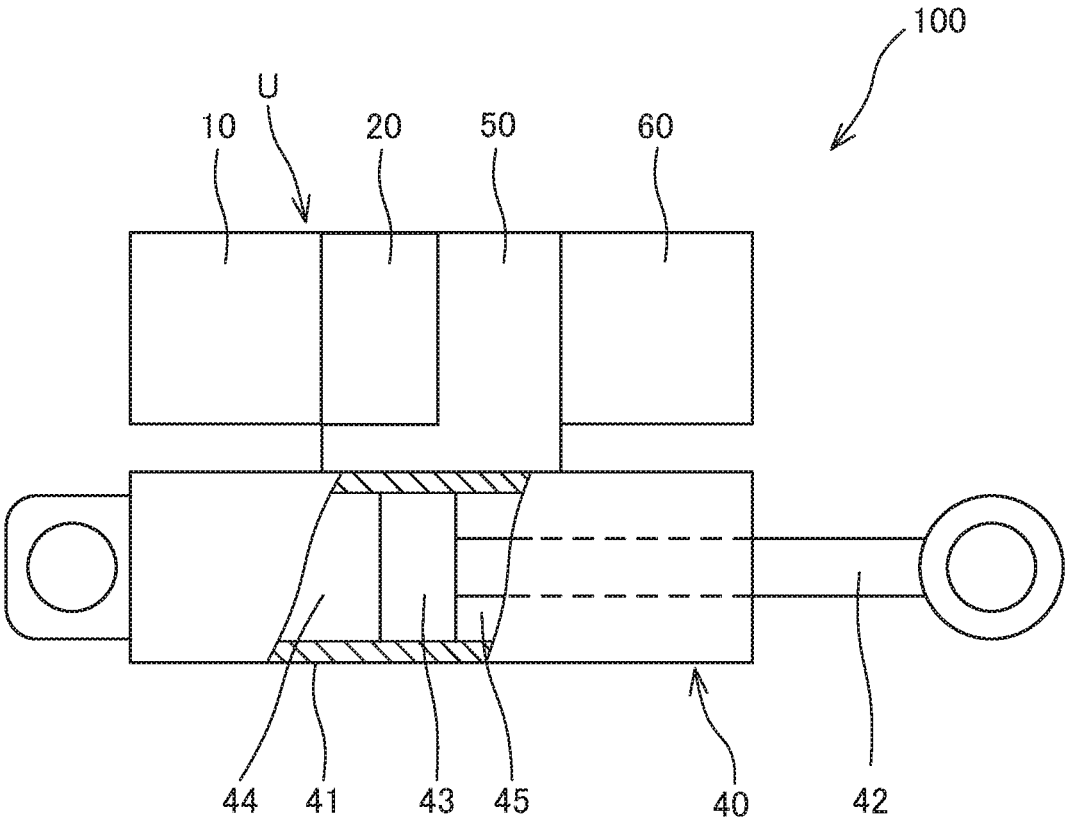
FIG. 1 is a partial sectional view showing an electric hydraulic actuator according to a first embodiment of the present invention.

An overall configuration of an electric hydraulic actuator according to a first embodiment of the present invention will be first described with main reference to FIG. 1. In the following, a description is given, as an example, for an electric hydraulic cylinder 100 utilizing working oil as working fluid.

As shown in FIG. 1, the electric hydraulic cylinder 100 is integrally provided with: an electric motor 10 that is rotated by a power supply; a tank 60 that stores the working oil; a gear pump 20 that is driven by the rotation by the electric motor 10 and discharges the working oil sucked from the tank 60; a hydraulic cylinder 40 serving as an actuator that is extended/contracted by working hydraulic pressure of the working oil discharged from the gear pump 20; and a control valve 50 that controls a flow of the working oil flowing between the hydraulic cylinder 40 and the gear pump 20. The electric motor 10, the tank 60, the gear pump 20, and the control valve 50 forms a single unit member U, and the unit member U is provided on the hydraulic cylinder 40 so as to be adjacent thereto. With such a configuration, it is possible to make the configuration of the electric hydraulic cylinder 100 more compact.

A power is supplied to the electric motor 10 by a PWM control performed by an inverter, for example, to control the rotation of the electric motor 10. The gear pump 20 is linked to a rotating shaft 12 of the electric motor 10 (see FIG. 2) that is rotated by the power supply and is driven by the rotation of the rotating shaft 12. The gear pump 20 is configured such that pump chambers 32 are formed between a pair of gears (a drive gear 21 and a driven gear 25) meshed with each other, and such that the working oil is sucked from the one direction and discharged to the other direction by the pump chambers 32 moved together wish the rotation of the gears (see FIG. 3). The gear pump 20 can be rotated in both directions according to the rotating direction of the electric motor 10, and the discharging direction is selectively switched according to the rotation. A specific configuration of the electric motor 10 and the gear pump 20 will be described later in detail.

As shown in FIG. 1, the hydraulic cylinder 40 is provided with a cylinder shaped cylinder tube 41, a piston rod 42 that is inserted into the cylinder tube 41 from one end side of the cylinder tube 41, and a piston 43 that is provided on an end portion of the piston rod 42 so as to be slidably moved along an inner circumferential surface of the cylinder tube 41.

An interior of the cylinder tube 41 is partitioned by the piston 43 into a bottom-side chamber 44 and a rod side chamber 45. The bottom-side chamber 44 and the rod side chamber 45 are filled with the working oil.

In the hydraulic cylinder 40, as the working oil is supplied to the bottom-side chamber 44 and the working oil is discharged from the rod side chamber 45, the piston rod 42 is moved in the extending direction (in the right direction in FIG. 1). In addition, in the hydraulic cylinder 40, as the working oil is supplied to the rod side chamber 45 and the working oil is discharged from the bottom-side chamber 44, the piston rod 42 is moved in the contracting direction (in the left direction in FIG. 1). As described above, the hydraulic cylinder 40 is a double acting type cylinder in which the piston rod 42 is moved back and forward by the working oil discharged from the gear pump 20.

The control valve 50 has an operation check valve (not shown), a slow return valve (not shown), or the like and controls the flow of the working oil between the hydraulic cylinder 40 and the gear pump 20. The control valve 50 is connected to the tank 60 via a tank passage (not shown). The tank 60 is an accumulator that stores the working oil by accumulating the pressure by a compressed gas. The configuration is not limited thereto, and the tank 60 may store the working oil without accumulating the pressure.

Figure 2:
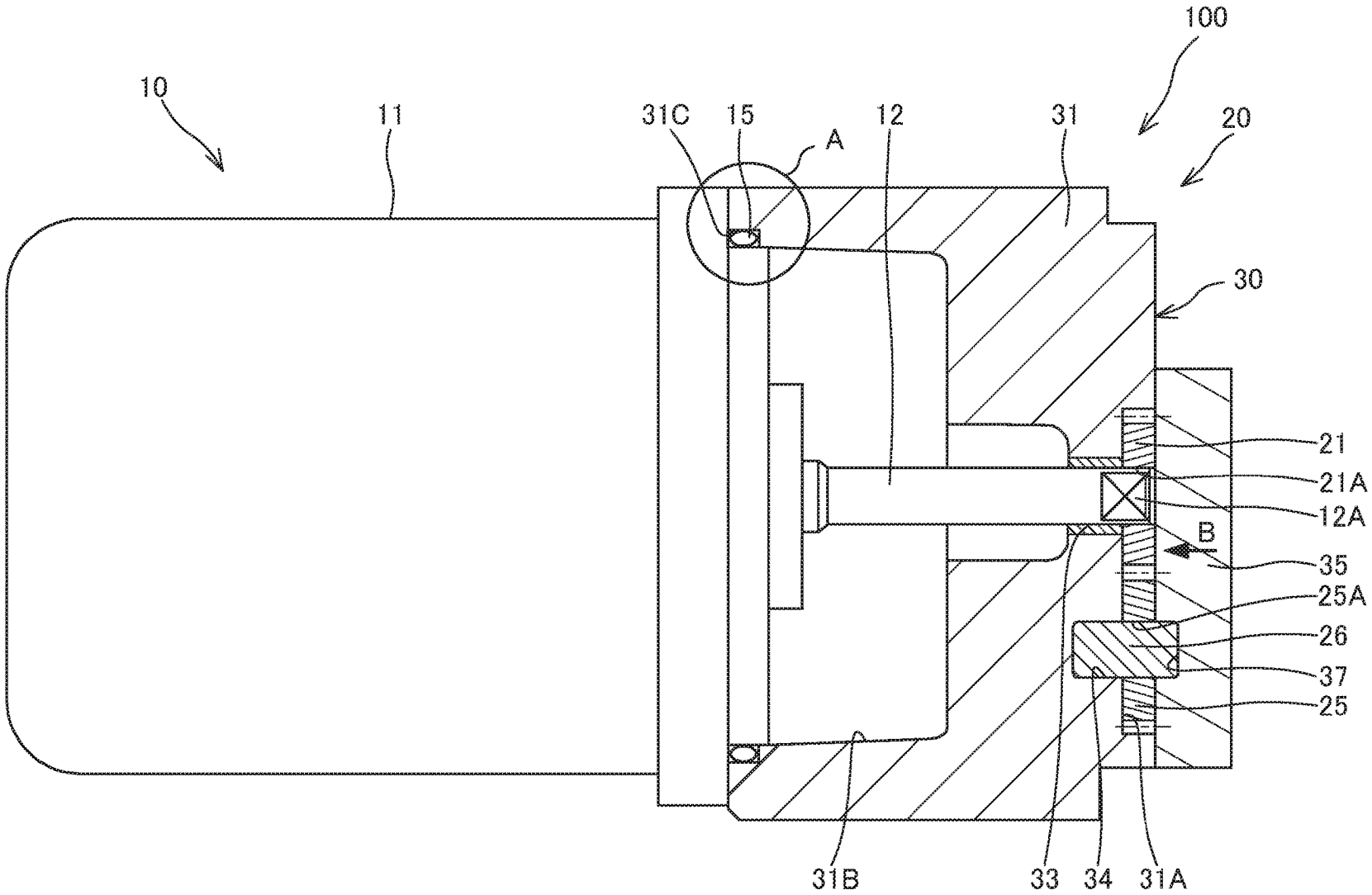
FIG. 2 is a partial sectional view showing an electric motor and a gear pump according to the first embodiment of the present invention.

Next, configuration of the electric motor 10 and the gear pump 20 will be described specifically with reference to FIGS. 1 to 5. In FIG. 2, only the configurations of the electric motor 10 and the gear pump 20 are illustrated, and illustration of other configurations are omitted. In addition, FIG. 3 is an enlarged plan view of the gear pump 20 viewed from an arrow B in FIG. 2.

As shown in FIG. 2, the electric motor 10 has a motor housing 11, the rotating shaft 12 that is supported by the motor housing 11 so as to be freely rotatable, and a driving portion that is received in the motor housing 11 and that rotationally drives the rotating shaft 12 by the power supply. Because a know configuration including a rotor, a stator, and so forth can be employed, illustration and detailed description of the driving portion are omitted.

Figure 3:
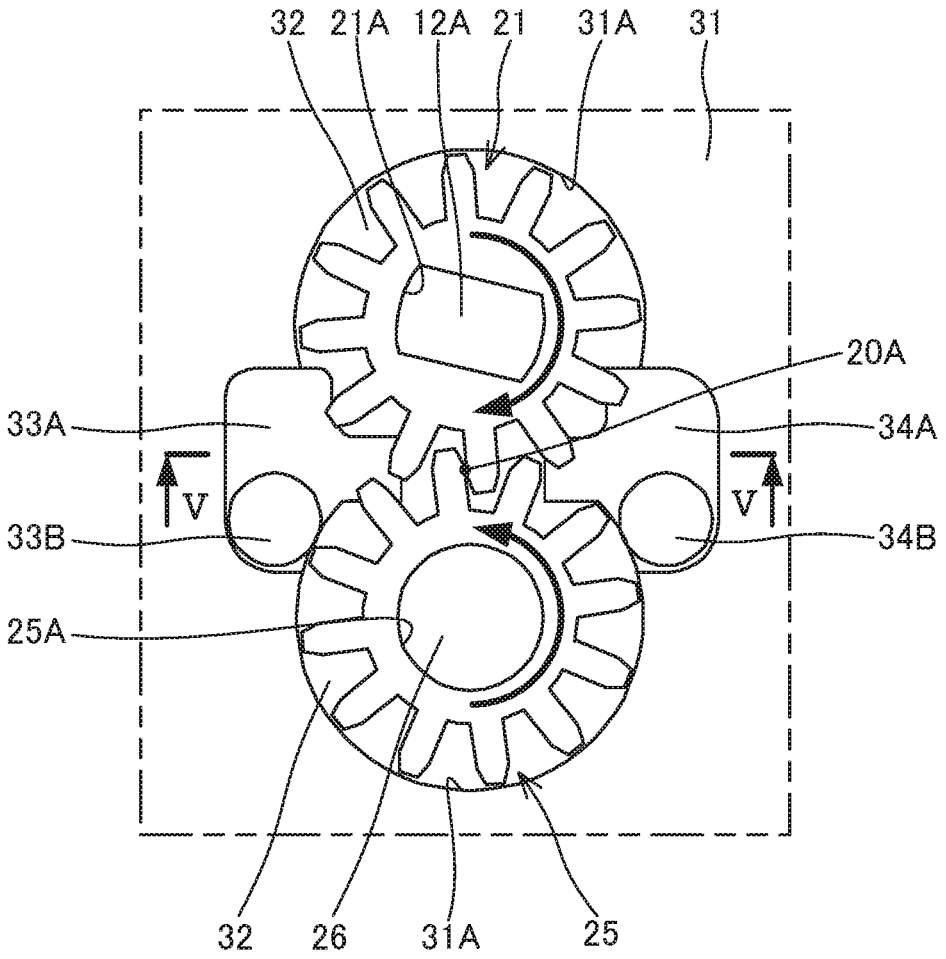
FIG. 3 is a partially enlarged plan view showing a configuration of the gear pump according to the first embodiment of the present invention.

As shown in FIG. 3, in the rotating shaft 12, a tip end portion 12A thereof has a width across flat shape (two-face width shape) that is formed by subjecting a cylinder surface to a planing process. The width across flat shape is a shape that has a pair of flat faces parallel with each other.

The gear pump 20 is a an external gear pump having the drive gear 21 and the driven gear 25 that are external gears meshed with each other and a pump housing 30 that accommodates the drive gear 21 and the driven gear 25.

As shown in FIGS. 2 and 3, the drive gear 21 is formed with an insertion through hole 21A into which the rotating shaft 12 of the electric motor 10 is inserted. The rotating shaft 12 of the electric motor 10 is inserted into the insertion through hole 21A such that the tip end portion 12A does not project out from an end surface of the drive gear 21. The insertion through hole 21A is formed to have a shape having a pair of flat surfaces parallel with each other so as to conform with a cross-sectional shape of the tip end portion 12A of the rotating shaft 12 of the electric motor 10 (see FIG. 3). With such a configuration, the rotation of the rotating shaft 12 of the electric motor 10 is transmitted to the drive gear 21, and the drive gear 21 is rotated together with the rotation of the rotating shaft 12. As described above, in the electric hydraulic cylinder 100, the rotating shaft 12 of the electric motor 10 functions as a driving shaft of the gear pump 20.

The driven gear 25 is rotated together with the rotation of the drive gear 21. The driven gear 25 is formed with an insert through hole 25A into which a driven shaft 26 is inserted. The driven shaft 26 is supported by a main housing 31 of the pump housing 30 and a cover 35, which will be described later, at both ends thereof.

As shown in FIG. 2, the pump housing 30 has the main housing 31 and the cover 35. The main housing 31 is formed with an accommodating concave portion 31A in which the drive gear 21 and the driven gear 25 are accommodated. The cover 35 seals the accommodating concave portion 31A such that the drive gear 21 and the driven gear 25 are brought into sliding contact therewith. In the pump housing 30, the cover 35 is directly attached to the main housing 31, and a side plate is not provided between the cover 35 and the main housing 31. In other words, the drive gear 21 and the driven gear 25 face the cover 35 so as to be directly brought into sliding contact therewith.

Figure 4:
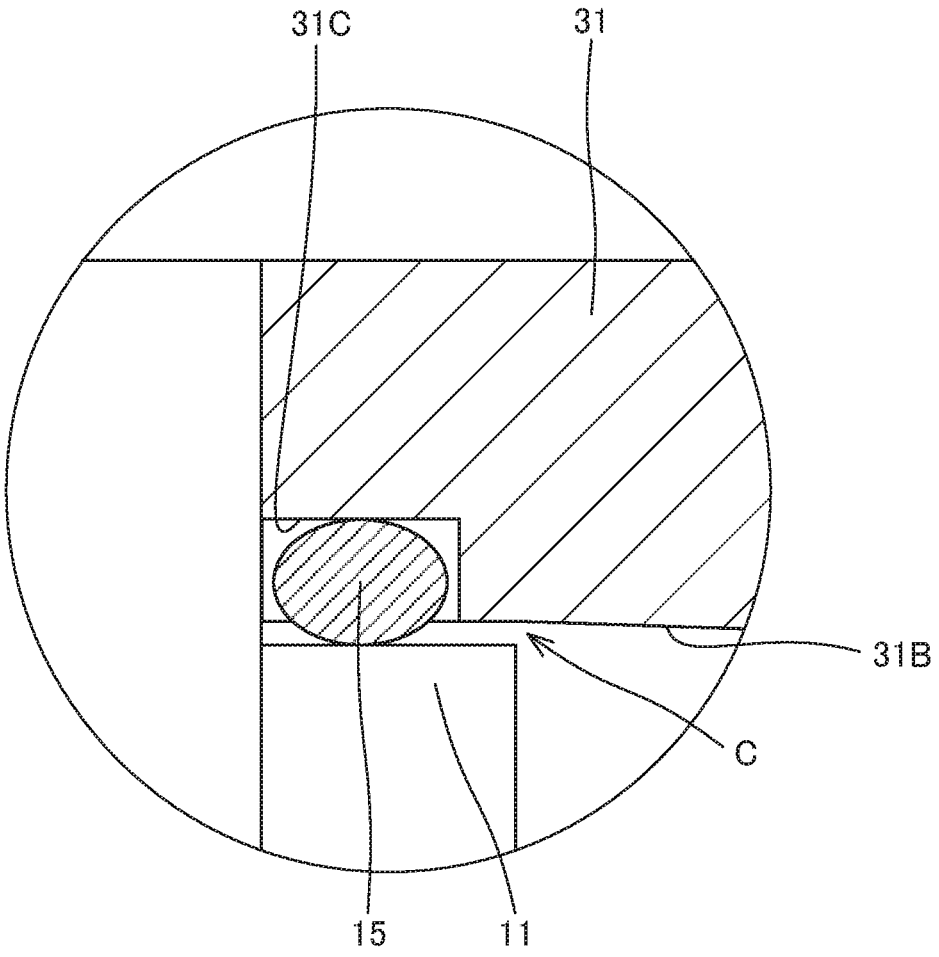
FIG. 4 is an enlarged view of a portion A in FIG. 2.

The main housing 31 is formed with an installation concave portion 31B that accommodates a part of the motor housing 11 of the electric motor 10. The motor housing 11 of the electric motor 10 is attached to the main housing 31 with bolts (not shown). As shown in FIG. 4, a gap C is formed between an inner circumferential surface of the installation concave portion 31B of the main housing 31 and an outer circumferential surface of the motor housing 11 so as to extend in the radial direction of the rotating shaft 12 (the top-bottom direction in FIGS. 2 and 4). An O-ring 15 that is formed of an elastic member and that seals the radial gap C is provided in the inner circumferential surface of the installation concave portion 31B. Specifically, the O-ring 15 is received in an annular groove 31C formed in the inner circumferential surface of the installation concave portion 31B and seals the radial gap C by being brought into contact with the outer circumferential surface of the motor housing 11. With such a configuration, the motor housing 11 is elastically supported in the radial direction by the O-ring 15 with respect to the pump housing 30.

In addition, as shown in FIG. 2, the main housing 31 is provided with a single bearing 33 that supports the rotating shaft 12 of the electric motor 10 freely rotatably. The bearing 33 is a bush (a slide bearing) on which the rotating shaft 12 is slidably moved. The configuration is not limited thereto, and the bearing 33 may be an antifriction bearing.

As shown in FIG. 3, in the accommodating concave portion 31A, the pump chambers 32 are defined by an inner circumferential surface of the accommodating concave portion 31A and outer circumferential surfaces of the drive gear 21 and the driven gear 25.

The main housing 31 is formed with a first pressure chamber 33A and a second pressure chamber 34A and a first port 33B and a second port 34B. The first pressure chamber 33A and the second pressure chamber 34A respectively communicate with the accommodating concave portion 31A and are positioned on either side of a meshing portion 20A of the drive gear 21 and the driven gear 25. The first port 33B and the second port 34B open at the first pressure chamber 33A and the second pressure chamber 34A, respectively, so as to guide the working oil. In this embodiment, the rotating shaft 12 of the electric motor 10 is rotated in both directions. In the following, a case in which the rotating shaft 12 is rotated clockwise in FIG. 3 (the arrow direction in FIG. 3) will be described as an example, and a description of a case in which the rotating shaft 12 is rotated anti-clockwise will be omitted.

In a case in which the rotating shaft 12 is rotated clockwise in FIG. 3, the working oil is sucked from the tank 60 through the first port 33B to the first pressure chamber 33A that is located on the finishing side of the meshing between the drive gear 21 and the driven gear 25 (the left side in FIG. 3). The working oil that has been guided to the first pressure chamber 33A is then guided to the pump chambers 32, and further guided to the second pressure chamber 34A by being pressurized by the rotation of the drive gear 21 and the driven gear 25. The working oil in the second pressure chamber 34A on the starting side of the meshing between the drive gear 21 and the driven gear 25 (the right side in FIG. 3) is supplied to the hydraulic cylinder 40 through the second port 34B.

As described above, in a case in which the rotating shaft 12 is rotated clockwise in FIG. 3, the first pressure chamber 33A on the finishing side of the meshing between the drive gear 21 and the driven gear 25 functions as a low pressure chamber into which the working oil is sucked from the tank 60, and the second pressure chamber 34A on the starting side of the meshing functions as a high pressure chamber from which the pressurized working oil is discharged. In addition, the first port 33B functions as a suction port for sucking the working oil, and the second port 34B functions as a discharge port for discharging the working oil. In a case in which the rotating shaft 12 is rotated anti-clockwise in FIG. 3, these functions are exchanged, and the first pressure chamber 33A functions as the high pressure chamber, the second pressure chamber 34A functions as the low pressure chamber, the first port 33B functions as the discharge port, and the second port 34B functions as the suction port.

Figure 5:
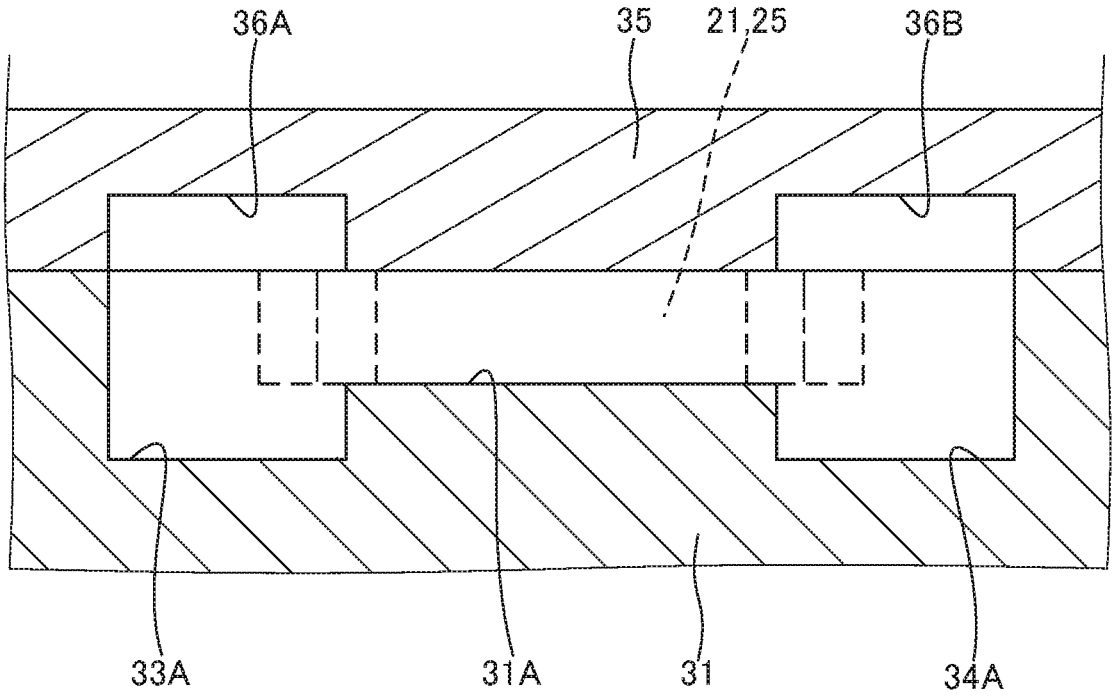
FIG. 5 is a sectional view taken along line V-V in FIG. 3.

As shown in FIG. 5, the cover 35 is formed with a suction groove 36A and a suction groove 36B. The suction groove 36A communicates with the first pressure chamber 33A and faces parts of the drive gear 21 and the driven gear 25 from the side surfaces thereof, and the suction groove 36B communicates with the second pressure chamber 34A and faces parts of the drive gear 21 and the driven gear 25 from the side surfaces thereof. The working oil that has been guided from the suction port to the low pressure chamber is sucked to the pump chambers 32 from the outer circumferences of the drive gear 21 and the driven gear 25, and at the same time, the working oil is also sucked to the pump chambers 32 from the side surfaces of the drive gear 21 and the driven gear 25 via the suction groove 36A or 36B. With such a configuration, a suction property of the working oil is improved. In FIG. 5, the drive gear 21 and the driven gear 25 are schematically shown by broken lines.

In addition, as shown in FIG. 2, a first press-fitting hole 34 and a second press-fitting hole 37, into which end portions of the driven shaft 26 are press-fitted, are formed in the main housing 31 and the cover 35, respectively. With such a configuration, the driven shaft 26 is double-end supported by the cover 35 and the main housing 31 at its both ends.

The rotating shaft 12 inserted into the drive gear 21 is provided so as not to project out from an end portion of the drive gear 21 on the cover 35 side such that the rotating shaft 12 and the cover 35 do not interfere with each other in a mutually non-contacting state. In other words, in the electric hydraulic cylinder 100, the rotating shaft 12 of the electric motor 10 is not supported by the cover 35 and is cantilever supported by the bearing 33 in the main housing 31.

The configuration is not limited thereto, and it may be possible to employ a configuration in which the driven shaft 26 is cantilever supported by either of the cover 35 and the main housing 31. In addition, as described below, it is desirable that the rotating shaft 12 of the electric motor 10 be cantilever supported only by the main housing 31 in order to facilitate the production thereof, however, the present invention is not limited thereto, and it may be possible to employ a double-end supported structure in which the rotating shaft 12 is also supported by the cover 35. In addition, the rotating shaft 12 may project out from the end surface of the drive gear 21. In this case, it may be possible to employ a configuration in which a recessed portion that forms a gap with the rotating shaft 12 may be formed in the cover 35 such that the rotating shaft 12 and the cover 35 do not interfere with each other.

Next, the effects of the electric hydraulic cylinder 100 will be described.

Effects upon assembly of the electric motor 10 and the gear pump 20 will be described first.

When the electric motor 10 and the gear pump 20 are assembled, the drive gear 21 and the driven gear 25 are first accommodated in the accommodating concave portion 31A of the main housing 31 so as to be meshed with each other, and the driven shaft 26 is inserted into the driven gear 25. Thereafter, the cover 35 is attached to the main housing 31 while press-fitting one end of the driven shaft 26 to the second press-fitting hole 37 of the cover 35.

Next, the O-ring 15 is received in the annular groove 31C that is formed in the inner circumferential surface of the installation concave portion 31B of the main housing 31. The rotating shaft 12 of the electric motor 10 and a part of the motor housing 11 are then accommodated into the main housing 31, and the rotating shaft 12 is inserted into the bearing 33 and the insertion through hole 21A of the drive gear 21. Furthermore, the motor housing 11 is attached to the main housing 31 of the pump housing 30 with the bolts.

In the above, the radial gap C is provided between the motor housing 11 of the electric motor 10 and the main housing 31 of the pump housing 30. In other words, processing accuracy is not required for attachment portions of the motor housing 11 and the main housing 31, and it is configured such that rattling of the motor housing 11 in the radial direction is allowed purposely when the motor housing 11 is attached to the main housing 31. By providing the O-ring 15 for sealing such radial gap C and by elastically supporting, by the O-ring 15, the motor housing 11 in the radial direction with respect to the pump housing 30, it becomes possible to allow movement of the motor housing 11 in the radial direction with the elasticity of the O-ring 15 upon the attachment.

Thus, it is possible to insert the rotating shaft 12 of the electric motor 10 into the bearing 33 and the insertion through hole 21A by adjusting the position of the electric motor 10 in the radial direction by deforming the O-ring 15. In other words, attachment of the motor housing 11 to the main housing 31 does not affect the positional alignment of the rotating shaft 12 with the bearing 33 and the insertion through hole 21A, and therefore, it is possible to attach the motor housing 11 to the pump housing 30 in a state in which the position of the rotating shaft 12 and the positions of the bearing 33 and the insertion through hole 21A are aligned.

As described above, because the rotating shaft 12 can be aligned accurately with the bearing 33 and the insertion through hole 21A, it is possible to reduce the size of the gaps formed between the rotating shaft 12 and the bearing 33 and between the rotating shaft 12 and the insertion through hole 21A, as much as possible. Therefore, misalignment of the rotating shaft 12 inserted into the drive gear 21 is suppressed, and it is possible to improve a mechanical efficiency of the gear pump 20.

In the above, the motor housing 11 may not be supported in the radial direction by the O-ring 15. For example, it may be possible to employ a configuration in which the O-ring 15 is not provided and only the gap C is provided between the motor housing 11 and the main housing 31 in the radial direction. Also in this case, when the motor housing 11 is to be attached to the main housing 31, it is possible to attach the motor housing 11 to the main housing 31 by moving the motor housing 11 in the radial direction with respect to the main housing 31, and by inserting the rotating shaft 12 into the bearing 33 and the insertion through hole 21A while ensuring the alignment therewith. Also in this case, because the main housing 31 and the motor housing 11 are attached to each other by the bolts, it is possible to prevent occurrence of the rattling of the main housing 31 and the motor housing 11 during the gear pump 20 is driven. Furthermore, in this case, in order to prevent entrance of external dust, etc., an O-ring may be provided in the shaft direction between the main housing 31 and the motor housing 11.

As described above, the electric motor 10 and the gear pump 20 are assembled.

Next, other effects of the electric hydraulic cylinder 100 than those afforded for the assembly will be described.

For ease of understanding the present invention, an electric hydraulic cylinder 300 according to a comparative example of the present invention will be described first with reference to FIG. 7.

Figure 7:
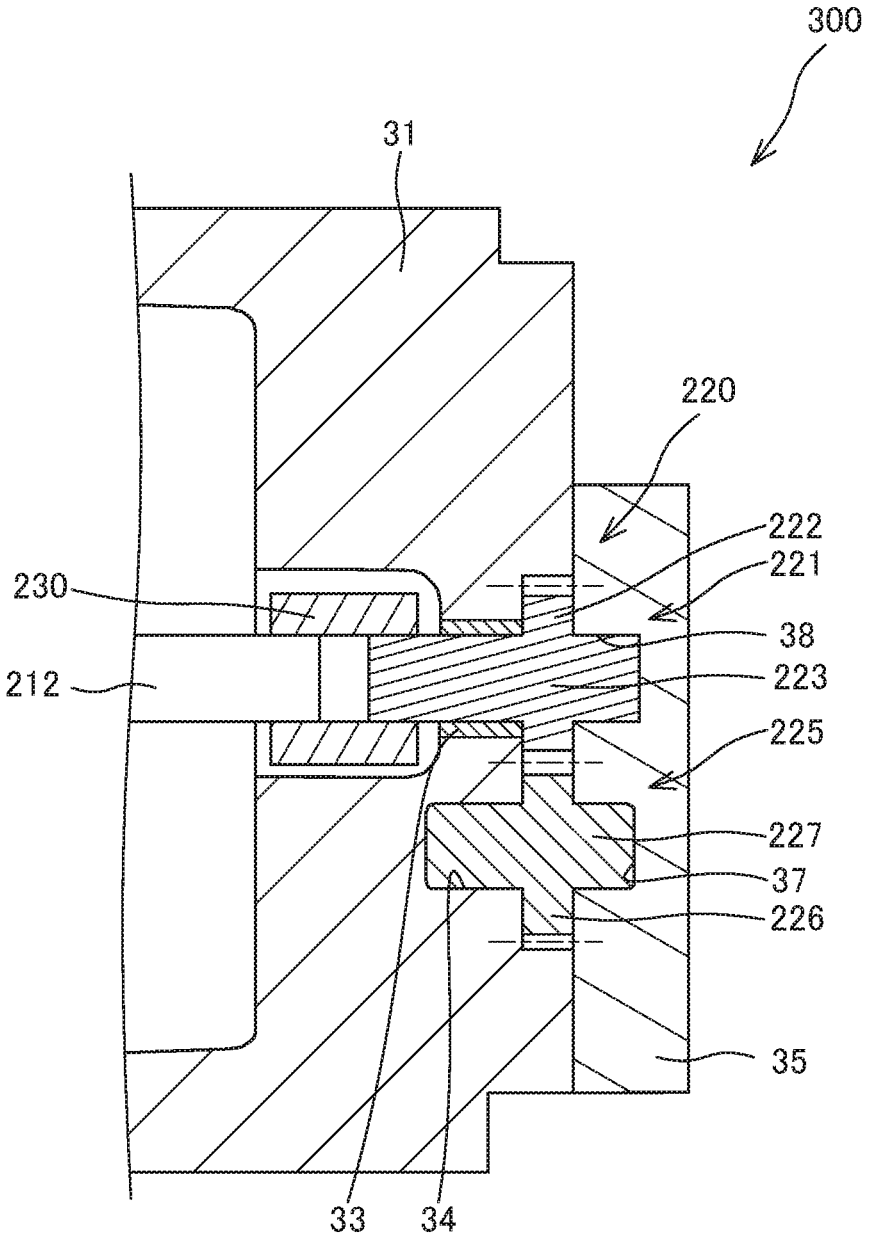
FIG. 7 is a sectional view showing the electric motor and the gear pump in the electric hydraulic actuator according to a comparative example of the present invention.

As shown in FIG. 7, in a gear pump 220 of the electric hydraulic cylinder 300 according to the comparative example, a drive gear 221 and a driven gear 225 have a driving shaft 223 and a driven shaft 227, respectively, that are respectively formed so as to extend from gear portions 222 and 226 in both sides in the shaft direction and so as to be integrated with the gear portions 222 and 226.

The driving shaft 223 of the drive gear 221 is linked to a rotating shaft 212 of the electric motor 10 by a coupling 230, and the rotation of the rotating shaft 212 is transmitted to the driving shaft 223 via the coupling 230. The driving shaft 223 of the drive gear 221 is supported by the bearing 33 in the main housing 31 and a support hole 38 formed in the cover 35 at both ends thereof.

The driven shaft 227 of the driven gear 225 is supported by a first press-fitting hole 34 of the main housing 31 and the second press-fitting hole 37 at both ends thereof. As described above, in the gear pump 220, both of the driving shaft 223 and the driven shaft 227 are double-end supported by the main housing 31 and the cover 35.

In the gear pump 220 having such a configuration, in order to improve the mechanical efficiency, the drive gear 221 and the driven gear 225 needs to be formed so as to achieve a high accuracy in perpendicularity of the gear portions 222 and 226 with respect to the driving shaft 223 and the driven shaft 227, and in coaxiality of a first side and a second side in the shaft direction of each of the driving shaft 223 and the driven shaft 227 that extend in the shaft direction so as to sandwich the gear portions 222 and 226, respectively. In addition, dimensions of through holes (the bearing 33, the support hole 38, the first press-fitting hole 34, and the second press-fitting hole 37) that are formed in the cover 35 and the main housing 31 for supporting the driving shaft 223 and the driven shaft 227 needs to be controlled tightly, and especially, the bearing 33 and the support hole 38 for supporting the driving shaft 223 and the first press-fitting hole 34 and the second press-fitting hole 37 for supporting the driven shaft 227 needs to be formed such that a high accuracy is ensured for the hole-to-hole dimensions therebetween. Therefore, the increase in the production cost of the electric hydraulic cylinder 300 is caused. In addition, because the coupling 230 is used to transmit the rotation by the electric motor 10, a cost is increased correspondingly, and at the same time, there is a risk in that the mechanical efficiency of the gear pump 220 is deteriorated due to the misalignment.

In contrast, in the electric hydraulic cylinder 100, the rotating shaft 12 of the electric motor 10 is inserted into the drive gear 21, and the rotation of the rotating shaft 12 is directly transmitted to the drive gear 21 without using the coupling 230, etc. In addition, the drive gear 21 and the driven gear 25 respectively have the insertion through hole 21A and the insert through hole 25A into which the rotating shaft 12 of the electric motor 10 (the driving shaft) and the driven shaft 26 are inserted, respectively, and the drive gear 21 and the driven gear 25 are formed as separate parts from the rotating shaft 12 and the driven shaft 26. Therefore, compared with a case in which the driving shaft and the driven shaft are formed integrally, there is no need to ensure the coaxiality and the perpendicularity, and the processing of the drive gear 21 and the driven gear 25 is facilitated, and therefore, it is possible to reduce the cost. In addition, because the coupling 230 is not required, it is correspondingly possible to further reduce the cost as the number of parts is reduced, and at the same time, it is possible to achieve a configuration the size of which is reduced.

In addition, in the electric hydraulic cylinder 100, because the drive gear 21 and the driven gear 25 are each formed separately from the rotating shaft 12 and the driven shaft 26 and processing thereof are facilitated, the processing accuracies for respective parts are improved. Because respective parts can be processed at a high accuracy, it is possible to improve the mechanical efficiency as the gear pump 20.

In addition, in the electric hydraulic cylinder 100, the side plate is not provided between the main housing 31 and the cover 35. Thus, only the alignment between the main housing 31 and the cover 35 is required, and the alignment of the side plate with the main housing 31 and the cover 35 is not required, and therefore, an assemblability of the gear pump 20 is improved.

In addition, in the electric hydraulic cylinder 100, the rotating shaft 12 of the electric motor 10 that is the driving shaft of the drive gear 21 does not interfere with the cover 35 and is cantilever supported by the main housing 31. Therefore, only the second press-fitting hole 37 for supporting the driven shaft 26 needs to be formed in the cover 35. In a case in which two holes for respectively supporting the rotating shaft 12 (the driving shaft) and the driven shaft 26 are formed, it is required to tightly control the hole-to-hole dimension. However, in the electric hydraulic cylinder 100, only one hole needs to be formed, and so, the processing of the cover 35 is facilitated. Furthermore, when the main housing 31 and the cover 35 are assembled, it suffices to assemble them by aligning the positions of the driven shaft 26 and the second press-fitting hole 37, and so, the assembly is facilitated. According to such a configuration, it is possible to improve the assemblability of the gear pump 20, and at the same time, it is possible to further reduce the cost.

According to the first embodiment described above, the advantages described below are afforded.

In the electric hydraulic cylinder 100, the motor housing 11 of the electric motor 10 is provided such that, between the motor housing 11 and the main housing 31 of the pump housing 30, the gap C is formed in the radial direction of the rotating shaft 12, and the motor housing 11 is supported in the radial direction by the O-ring 15. Thus, the attachment of the motor housing 11 to the main housing 31 does not affect the alignment between the rotating shaft 12 and the drive gear 21. In other words, because the motor housing 11 can be attached to the main housing 31 in a state in which the rotating shaft 12 is located at a desired position, the alignment between the rotating shaft 12 and the drive gear 21 in the radial direction can be achieved with a high accuracy, and it is possible to suppress the misalignment between the rotating shaft 12 and the drive gear 21. Therefore, it is possible to improve the mechanical efficiency of the gear pump 20 in the electric hydraulic cylinder 100.

In addition, in the electric hydraulic cylinder 100, the driving shaft of the drive gear 21 is the rotating shaft 12 of the electric motor 10, and the rotation of the rotating shaft 12 is directly transmitted to the drive gear 21 without using the coupling 230, etc. In addition, the drive gear 21 and the driven gear 25 are formed as separate parts from the rotating shaft 12 that is the driving shaft and the driven shaft 26. Thus, the processing of the drive gear 21 and the driven gear 25 is facilitated, and therefore, it is possible to reduce the cost. In addition, because the coupling 230 is not required, it is correspondingly possible to further reduce the cost as the number of parts is reduced, and at the same time, it is possible to achieve a configuration the size of which is reduced.

In addition, because the drive gear 21 and the driven gear 25 are each formed separately from the rotating shaft 12 and the driven shaft 26 and processing thereof are facilitated, the processing accuracies for respective parts are improved. Because respective parts can be processed at a high accuracy, it is possible to improve the mechanical efficiency as the gear pump 20.

In addition, in the electric hydraulic cylinder 100, the side plate is not provided between the main housing 31 and the cover 35, and the rotating shaft 12 of the electric motor 10 that is the driving shaft of the drive gear 21 is cantilever supported by the main housing 31. Thus, compared with a case in which the rotating shaft 12 is double-end supported, the cover 35 needs not be formed with two holes for supporting the rotating shaft 12 and the driven shaft 26, and the assembly of the gear pump 20 may be performed by assembling the main housing 31 and the cover 35 by aligning the driven shaft 26 to the second press-fitting hole 37 of the cover 35. Therefore, it is possible to improve the assemblability of the gear pump and to further reduce the cost.

Second Embodiment

Figure 6:
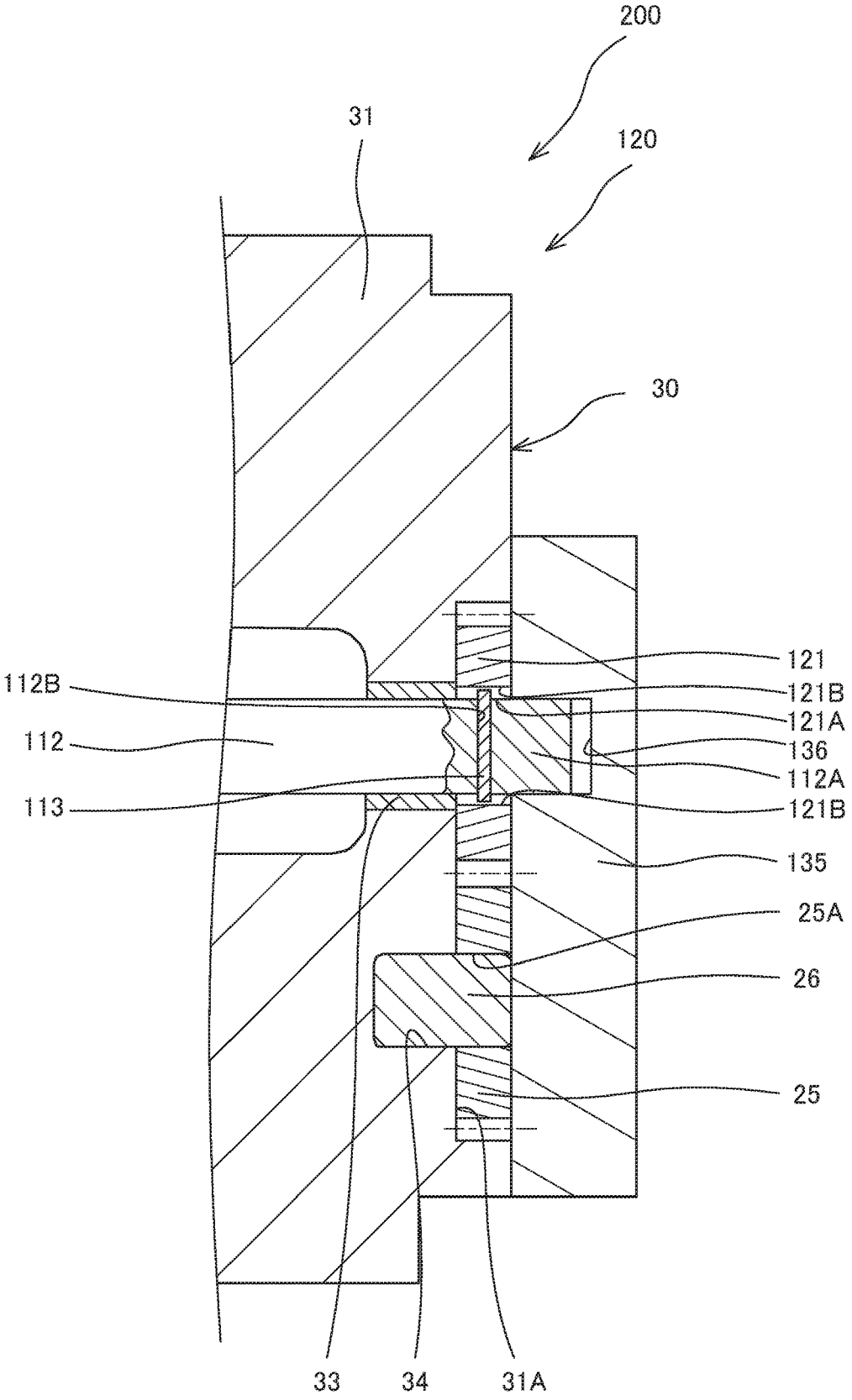
FIG. 6 is an enlarged sectional view showing the electric motor and the gear pump in the electric hydraulic actuator according to a second embodiment of the present invention.

Next, a second embodiment of the present invention will be described with reference to FIG. 6. In the following, differences from the above-described first embodiment will be mainly described, and components that are the same as those in the electric hydraulic cylinder 100 of the above-described first embodiment are assigned the same reference numerals and descriptions thereof will be omitted. FIG. 6 is an enlarged view showing a linkage portion between a rotating shaft 112 of the electric motor 10 and a gear pump 120. The configuration not shown in FIG. 6 is similar to that in the above-described first embodiment, and descriptions thereof will be omitted below.

In the electric hydraulic cylinder 100 according to the above-described first embodiment, the tip end portion 12A of the rotating shaft 12 of the electric motor 10 is formed to have the shape having the pair of flat surfaces parallel with each other in the circular shaped shaft, and the tip end portion 12A is inserted into the insertion through hole 21A of the drive gear 21 that is formed to have the shape that conforms with the shape of the tip end portion 12A. With such a configuration, the rotation of the rotating shaft 12 of the electric motor 10 is transmitted to the drive gear 21, and the drive gear 21 is rotated together with the rotation of the rotating shaft 12.

In contrast, in an electric hydraulic cylinder 200 according to the second embodiment, a tip end portion 112A of the rotating shaft 112 of the electric motor 10 is formed so as to have, similarly to the other portion, a circular cross-section. The rotating shaft 112 of the electric motor 10 is linked to a drive gear 121 of the gear pump 120 such that relative rotation thereof is not allowed by a linkage pin 113 serving as a linkage member. With such a configuration, the rotation of the rotating shaft 112 of the electric motor 10 is transmitted to the drive gear 121. In the following, a configuration of the electric hydraulic cylinder 200 will be described specifically.

As shown in FIG. 6, the electric hydraulic cylinder 200 is provided with the linkage pin 113 by which the rotating shaft 112 of the electric motor 10 and the drive gear 121 are linked such that the relative rotation therebetween is not allowed and with which the rotation of the rotating shaft 112 is transmitted to the drive gear 121.

At least a portion of the rotating shaft 112 of the electric motor 10, including the tip end portion 112A, that projects out from the motor housing 11 is formed to have a uniform circular cross-section. The tip end portion 112A of the rotating shaft 112 is supported so as to be rotatable by being inserted into a tip-end receiving hole 136 formed in a cover 135. As described above, in the electric hydraulic cylinder 200, the rotating shaft 112 of the electric motor 10 is supported by the main housing 31 and the cover 135 at its both ends. In addition, the cover 135 is not formed with the second press-fitting hole 37 into which the driven shaft 26, which is inserted through the driven gear 25, is press-fitted, and the driven shaft 26 is cantilever supported by the main housing 31.

A pin through hole 112B into which the linkage pin 113 is inserted is formed in the rotating shaft 112 of the electric motor 10. The pin through hole 112B penetrates through the rotating shaft 112 in the radial direction.

An insertion through hole 121A of the drive gear 121 is formed so as to have a shape that is conformed to the tip end portion 112A of the rotating shaft 112 of the electric motor 10, in other words, a circular cross-sectional shape. In addition, an inner circumference of the insertion through hole 121A is formed with two axial grooves 121B that are provided so as to extend along the axial direction and that respectively receive both end portions of the linkage pin 113 projected from the pin through hole 112B of the rotating shaft 112. The two axial grooves 121B are formed so as to be shifted with each other by 180° in the circumferential direction so as to face each other on either side of the center axis of the drive gear 121. In addition, the axial grooves 121B are formed so as to penetrate through the drive gear 121 in the axial direction and respectively open on both end surfaces of the drive gear 121.

The axial grooves 121B is formed so as to have a width (a length in a direction orthogonal to the plane of FIG. 6) that is longer than the diameter of the linkage pin 113. In addition, the linkage pin 113 is formed so as to be longer than the diameter of the rotating shaft 112. With such a configuration, as shown in FIG. 6, the both end portions of the linkage pin 113 inserted into the pin through hole 112B project out from the pin through hole 112B and are respectively received in the axial grooves 121B of the drive gear 121.

In addition, the axial grooves 121B are respectively formed to have a depth (a length along the radial direction of the drive gear 121) such that in a state in which the one end of the linkage pin 113 is brought into contact with a bottom portion of one of the axial grooves 121B, the other end of the linkage pin 113 projects out from the pin through hole 112B. With such a configuration, even if the linkage pin 113 is moved in the pin through hole 112B along the radial direction of the rotating shaft 112, the other end of the linkage pin 113 comes to contact with the bottom portion of the axial grooves 121B before the one end of the linkage pin 113 is received in the pin through hole 112B. Thus, a state in which the both end portions of the linkage pin 113 are received in the axial grooves 121B is maintained.

As the rotating shaft 112 of the electric motor 10 is rotated, the both end portions of the linkage pin 113 come to contact with inner circumferential surfaces of the axial grooves 121B, and so, the drive gear 121 is rotated together with the rotating shaft 112 of the electric motor 10. As described above, with the linkage pin 113, the rotating shaft 112 of the electric motor 10 and the drive gear 121 are linked such that the relative rotation therebetween is not allowed, and so, the rotation of the rotating shaft 112 is transmitted to the drive gear 121.

In addition, because a state in which the both end portions of the linkage pin 113 are received in the axial grooves 121B is maintained, a state in which only one end of the linkage pin 113 is brought into contact with the axial grooves 121B is avoided, and it is possible to bring the both end portions into contact with the axial grooves 121B. Thus, it is possible to transmit the rotation of the rotating shaft 112 of the electric motor 10 to the drive gear 121 with higher reliability. In addition, because the both ends of the linkage pin 113 are brought into contact with the axial grooves 121B, compared with a case in which only one end thereof is brought into contact, it is possible to disperse a shear force applied to the linkage pin 113 by the rotation of the rotating shaft 112. Thus, it is possible to improve the durability of the linkage pin 113.

As in the above-described first embodiment, with the tip end portion 12A of the rotating shaft 12 that is formed so as to have the pair of flat surfaces parallel with each other, compared with a case in which it is formed so as to have the circular cross-sectional shape, the cross-sectional area thereof is reduced correspondingly to the amount subjected to the planing process. With such a tip end portion 12A, a strength thereof is deteriorated relatively against a perpendicular force applied to the portion subjected to the planing process compared with a force applied from other directions, and the tip end portion 12A tends to be distorted with ease. As described above, with the rotating shaft 12 of the electric motor 10 according to the first embodiment, because there is anisotropy in the strength against the force causing distortion of the rotating shaft 12, there is a risk in that the distortion is caused by the rotation, and the drive gear 121 is vibrated.

In contrast, in the electric hydraulic cylinder 200, the rotation of the rotating shaft 112 is transmitted to the drive gear 121 by the linkage pin 113. In the electric hydraulic cylinder 200, the rotating shaft 112 of the electric motor 10 does not have the tip end portion 12A that has the width across flat shape as in the above-described first embodiment, but has the uniform circular cross-sectional shape. In the electric hydraulic cylinder 200, because the rotating shaft 112 is formed to have the uniform circular cross-sectional shape, the reduction in the cross-sectional area of the tip end, which is caused when the rotating shaft 112 is formed to the width across flat shape, is prevented, and so, relative deterioration of the strength for the direction of application of a force, in other words, anisotropy in the strength is not caused. Thus, it is possible to suppress the distortion of the rotating shaft 112 of the electric motor 10 and to suppress the vibration of the drive gear 121.

In addition, because the insertion through hole 121A of the drive gear 121 is formed so as to have the circular cross-section, it is possible to form the driven shaft 26 that is inserted into the driven gear 25 and the rotating shaft 112 so as to have the same diameters and to achieve standardization of the drive gear 121 and the driven gear 25. Thus, it is possible to reduce the production cost of the electric hydraulic cylinder 200. In the above, no functional problem is caused even when the driven gear 25 is formed with the axial grooves 121B.

In the assembly of the gear pump 120, the rotating shaft 112 of the electric motor 10 is first inserted into the main housing 31. The linkage pin 113 is then inserted into the pin through hole 112B of the rotating shaft 112. In this state, the drive gear 121 is inserted into the main housing 31 such that the positions of the linkage pin 113 and the axial grooves 121B are aligned. At this time, the both end portions of the linkage pin 113 are received into the axial grooves 121B in the axial direction from the one end surface of the drive gear 121. Furthermore, the driven gear 25 is accommodated in the main housing 31 so as to be meshed with the drive gear 121, and the cover 135 is attached to the main housing 31 such that the positions of the rotating shaft 112 and the tip-end receiving hole 136 are aligned. As described above, the gear pump 120 is assembled.

As described above, because the rotating shaft 112 is supported by the main housing 31 and the cover 135 at both ends thereof, the distortion is further suppressed. In addition, the driven shaft 26 inserted into the driven gear 25 is not supported by the cover 135, and the driven shaft 26 is cantilever supported only by the main housing 31. Thus, during its assembly, as described above, it suffices to assemble the main housing 31 and the cover 135 by inserting the rotating shaft 112 so as to be aligned with the tip-end receiving hole 136 of the cover 135. With such a configuration, even if the rotating shaft 112 is double-end supported, similarly to the above-described first embodiment, it is possible to improve the assemblability of the gear pump 120 and to reduce the cost.

Next, a modification of the second embodiment will be described.

In the above-described second embodiment, the linkage member is the linkage pin 113 that is inserted into the pin through hole 112B penetrating through the rotating shaft 112 of the electric motor 10 in the radial direction. In this case, because the processing of the rotating shaft 112 of the electric motor 10 is formation of the penetrating through hole, the processing can be performed easily compared with formation of non-penetrating through hole, etc. In contrast, as long as the rotation of the rotating shaft 112 of the electric motor 10 is transmitted to the drive gear 121, the linkage member may not be the linkage pin 113. For example, one or more key grooves may be formed in an outer circumferential surface of the rotating shaft 112, and a key to be inserted into the key groove may be used as the linkage member. In addition, in the electric hydraulic cylinder 200, a plurality of linkage pins 113 serving as the linkage members may be provided, and two or more pin holes serving as the non-penetrating holes, into which the linkage pins 113 are inserted, may be formed. The pin holes may be formed in the outer circumferential surface of the rotating shaft 112 so as to be arranged side by side in the circumferential direction.

In addition, in the above-described second embodiment, the driven shaft 26 is cantilever supported by the main housing 31. From the viewpoint of the suppression of the distortion of the rotating shaft 112 of the electric motor 10, the improvement of the assemblability, and the reduction in the cost, it is desirable to employ a configuration in which the rotating shaft 112 is double-end supported and the driven shaft 26 is cantilever supported by the main housing 31. However, the driven shaft 26 may be double-end supported by the main housing 31 and the cover 135. In addition, similarly to the above-described first embodiment, the rotating shaft 112 of the electric motor 10 may be cantilever supported by the main housing 31, and the driven shaft 26 may be double-end supported by the main housing 31 and the cover 135.

According to the above-described second embodiment, in addition to the advantages similar to those offered by the above-described first embodiment, the advantages described below are afforded.

In the electric hydraulic cylinder 200 according to the second embodiment, the rotation of the rotating shaft 112 is transmitted to the drive gear 121 by the linkage pin 113, and the rotating shaft 112 is not formed to have the width across flat shape. As described above, by forming the rotating shaft 112 to have the uniform circular cross-sectional shape, the reduction in the cross-sectional area in the tip end, which is caused with the width across flat shape, is prevented. Thus, it is possible to prevent the distortion of the rotating shaft 112 of the electric motor 10 and to suppress the vibration of the drive gear 121.

In addition, because the rotating shaft 112 of the electric motor 10 is double-end supported by the main housing 31 and the cover 135, it is possible to further suppress the distortion.

In addition, because the insertion through hole 121A of the drive gear 121 is formed to have the circular cross-section that is conformable to the rotating shaft 112, it is possible to achieve standardization of the drive gear 121 and the driven gear 25. Thus, it is possible to reduce the cost.

The configurations, operations, and effects of the embodiment of the present invention will be collectively described below.

The electric hydraulic cylinder (100, 200) is provided with: the electric motor 10 configured to be rotated by the power supply; the gear pump (20, 120) configured to be driven by the rotation by the electric motor 10; and the hydraulic cylinder 40 configured to be extended/contracted by pressure of the working oil supplied by the gear pump (20, 120), wherein the electric motor 10 has the motor housing 11 and the rotating shaft (12, 112) supported by the motor housing 11 so as to be freely rotatable, the gear pump (20, 120) has: the drive gear (21, 121) into which the rotating shaft (12, 112) of the electric motor 10 is inserted, the drive gear (21, 121) being configured so as to be rotated together with the rotation of the rotating shaft (12, 112); the driven gear 25 meshed with the drive gear (21, 121); and the pump housing 30 configured to accommodate the drive gear (21, 121) and the driven gear 25, and the motor housing 11 of the electric motor 10 is attached to the pump housing 30 such that the gap C is formed between the motor housing 11 and the pump housing 30 in the radial direction of the rotating shaft (12, 112).

In addition, the electric hydraulic cylinder (100, 200) is further provided with the O-ring 15 provided in the gap C between the motor housing 11 and the pump housing 30, the O-ring 15 being configured to elastically support the motor housing 11 in the radial direction.

According to the above-described configurations, because the motor housing 11 of the electric motor 10 is provided such that the gap C is formed between the motor housing 11 and the pump housing 30 in the radial direction of the rotating shaft (12, 112), the attachment of the motor housing 11 to the pump housing 30 does not affect the alignment between the rotating shaft (12, 112) and the drive gear (21, 121). In other words, because the motor housing 11 can be attached to the pump housing 30 in a state in which the rotating shaft (12, 112) is located at the desirable position, it is possible to perform alignment between the rotating shaft (12, 112) and the drive gear (21, 121) in the radial direction and to suppress the misalignment between the rotating shaft (12, 112) and the drive gear (21, 121). Therefore, it is possible to improve the mechanical efficiency of the electric hydraulic cylinder (100, 200).

In addition, in the electric hydraulic cylinder (100, 200), the pump housing 30 has: the main housing 31 formed with the accommodating concave portion 31A, the accommodating concave portion 31A being configured to accommodate the drive gear (21, 121) and the driven gear 25; and the cover (35, 135) configured to seal the accommodating concave portion 31A, the cover (35, 135) being configured such that the drive gear (21, 121) and the driven gear 25 are brought into sliding contact with the cover (35, 135).

According to this configuration, because the side plate is not provided between the main housing 31 and the cover (35, 135), it is possible to assemble the gear pump (20, 120) only by aligning the main housing 31 and the cover (35, 135). Thus, the assemblability of the gear pump (20, 120) is improved.

In addition, in the electric hydraulic cylinder 100, the rotating shaft 12 is supported by the main housing 31 and is not supported by the cover 35.

In addition, in the electric hydraulic cylinder (100, 200), the main housing 31 is provided with the single bearing 33 that supports the rotating shaft (12, 112) so as to be freely rotatable.

According to the above-described configuration, because the rotating shaft 12 is cantilever supported by the main housing 31, there is no need to form a hole for supporting the rotating shaft 12 in the cover 35. Because the hole for supporting the rotating shaft 12 needs to be formed with a high accuracy to ensure the mechanical efficiency, by forming the hole in the cover 35, the cost is increased. In the above-described configuration, there is no need to form such a hole in the cover 35, and therefore, the processing of the cover 35 is facilitated, and it is possible to reduce the cost.

In addition, in the electric hydraulic cylinder (100, 200), the main housing 31 is formed with the first pressure chamber 33A and the second pressure chamber 34A configured to communicate with the accommodating concave portion 31A, the first pressure chamber 33A and the second pressure chamber 34A being disposed so as to be opposed to each other on either side of the meshing portion 20A between the drive gear (21, 121) and the driven gear 25, the first pressure chamber 33A and the second pressure chamber 34A being configured such that the working oil is guided thereto, the pump chambers 32 are formed between the drive gear (21, 121) and the accommodating concave portion 31A and between the driven gear 25 and the accommodating concave portion 31A, and the cover (35, 135) is formed with the suction groove (36A, 36B), the suction groove (36A, 36B) being configured such that the working oil in the first pressure chamber 33A or the second pressure chamber 34A is guided to the pump chambers 32 from the side surfaces of the drive gear (21, 121) and the driven gear 25.

According to this configuration, because the working oil can also be sucked into the pump chambers 32 from the side surfaces of the drive gear (21, 121) and the driven gear 25 through the suction groove (36A, 36B), the suction property is improved.

In addition, in the electric hydraulic cylinder 100, the gear pump 20 further has the driven shaft 26 inserted into the driven gear 25, and the driven shaft 26 is supported by the main housing 31 and the cover 35 at each of both ends.

According to this configuration, because the driven shaft 26 is double-end supported by the main housing 31 and the cover 35, upon the assembly of the gear pump 20, it is possible to assemble the gear pump 20 by only aligning the positions of the driven shaft 26 and the cover 35. Thus, the assemblability is improved.

In addition, the electric hydraulic cylinder 200 is further provided with the linkage member (the linkage pin 113) configured to transmit the rotation of the rotating shaft 112 to the drive gear 121 by linking the rotating shaft 112 and the drive gear 121 such that the relative rotation is not allowed, wherein the rotating shaft 112 of the electric motor 10 is formed to have the uniform circular cross-sectional shape.

In addition, in the electric hydraulic cylinder 200, the rotating shaft 112 is formed with the pin through hole 112B penetrating therethrough in the radial direction, the two axial grooves 121B are formed in an inner circumferential surface of the drive gear 121 so as to extend in the axial direction, and the linkage member is the linkage pin 113, the linkage pin 113 being configured so as to be inserted into the pin through hole 112B, and the linkage pin 113 being configured such that its both end portions are received in the axial grooves 121B.

According to the above-described configuration, because the rotating shaft 112 is formed to have the circular cross-section, and the rotation is transmitted by the linkage pin 113, the anisotropy is not caused in the strength of the rotating shaft 112. Thus, it is possible to suppress occurrence of the vibration of the drive gear 121 caused by the distortion of the rotating shaft 112.

Embodiments of this invention were described above, but the above embodiments are merely examples of applications of this invention, and the technical scope of this invention is not limited to the specific constitutions of the above embodiments.

The configurations, including the modifications thereof, described in the respective embodiments described above may be appropriately combined within the permissible scope.

This application claims priority based on Japanese Patent Application No. 2017-252041 filed with the Japan Patent Office on Dec. 27, 2017, the entire contents of which are incorporated into this specification.

The invention claimed is:

1. An electric hydraulic actuator, comprising:

an electric motor configured to be rotated by a power supply;

a gear pump configured to be driven by rotation of the electric motor; and an actuator configured to be extended/contracted by pressure of working fluid supplied by the gear pump, wherein the electric motor has a motor housing and a rotating shaft supported by the motor housing so as to be freely rotatable, the gear pump includes a drive gear into which the rotating shaft is inserted, the drive gear being configured so as to be rotated together with rotation of the rotating shaft;

a driven gear meshed with the drive gear;

an O-ring; and a pump housing configured to accommodate the drive gear and the driven gear, the motor housing and the pump housing are two separate housings, and the motor housing is attached to the pump housing such that a gap is formed between the motor housing and the pump housing in a radial direction of the rotating shaft, the pump housing includes an installation concave portion having a hollow hole that is open at an end surface of the pump housing, the installation concave portion accommodating a part of the motor housing, the rotating shaft passing through the installation concave portion, the motor housing is attached to the pump housing with bolts and includes an insertion portion inserted into the installation concave portion, the gap being provided between an inner circumferential surface of the installation concave portion and an outer circumferential surface of the insertion portion, and the O-ring is provided in the gap and configured to elastically support the motor housing in the radial direction.

2. The electric hydraulic actuator according to claim 1, wherein the pump housing has:

a main housing that includes an accommodating concave portion and the installation concave portion, the accommodating concave portion being configured to accommodate the drive gear and the driven gear; and a cover configured to seal the accommodating concave portion, the cover being configured such that the drive gear and the driven gear are brought into sliding contact with the cover.

3. The electric hydraulic actuator according to claim 2, wherein the rotating shaft is supported by the main housing and is not supported by the cover.

4. The electric hydraulic actuator according to claim 3, wherein the gear pump further has a driven shaft inserted into the driven gear, and the driven shaft is supported by the main housing and the cover at each of both ends.

5. The electric hydraulic actuator according to claim 1, further comprising a linkage member configured to transmit rotation of the rotating shaft to the drive gear by linking the rotating shaft and the drive gear such that relative rotation is not allowed, wherein the rotating shaft is formed to have a uniform circular cross section.

6. The electric hydraulic actuator according to claim 5, wherein the rotating shaft includes a pin through hole penetrating therethrough in the radial direction, two axial grooves are formed in an inner circumferential surface of the drive gear so as to extend in an axial direction, and the linkage member is a linkage pin having opposite end portions, the linkage pin being configured so as to be inserted into the pin through hole, and the linkage pin being configured such that its opposite end portions are respectively received in the axial grooves.

7. The electric hydraulic actuator according to claim 1, wherein the motor housing and the pump housing are configured to rotatably and respectively support the rotating shaft, the pump housing supporting the rotating shaft via a bearing.

8. An electric hydraulic actuator, comprising:

an electric motor configured to be rotated by a power supply;

a gear pump configured to be driven by rotation of the electric motor; and an actuator configured to be extended/contracted by pressure of working fluid supplied by the gear pump, wherein the electric motor has a motor housing and further includes a rotating shaft supported by the motor housing so as to be freely rotatable, the gear pump includes a drive gear into which the rotating shaft of the electric motor-is inserted, the drive gear being configured so as to be rotated together with rotation of the rotating shaft;

a driven gear meshed with the drive gear; and a pump housing configured to accommodate the drive gear and the driven gear, the motor housing of the electric motor is attached to the pump housing such that a gap is formed between the motor housing and the pump housing in a radial direction of the rotating shaft, the pump housing has:

a main housing including an accommodating concave portion, the accommodating concave portion accommodating the drive gear and the driven gear; and a cover configured to seal the accommodating concave portion, the cover being configured such that the drive gear and the driven gear are brought into sliding contact with the cover, the main housing includes a first pressure chamber and a second pressure chamber that are configured to communicate with the accommodating concave portion, the first pressure chamber and the second pressure chamber being disposed so as to be opposed to each other on either side of a meshing portion between the drive gear and the driven gear, and the first pressure chamber and the second pressure chamber being configured such that the working fluid is guided thereto, pump chambers are formed between the drive gear and the accommodating concave portion and between the driven gear and the accommodating concave portion, and the cover has a suction groove, the suction groove being configured such that the working fluid in the first pressure chamber or the second pressure chamber is guided to the pump chambers from side surfaces of the drive gear and the driven gear.

9. The electric hydraulic actuator according to claim 8, further comprising an O-ring provided in the gap between the motor housing and the pump housing, the O-ring being configured to elastically support the motor housing in the radial direction.

10. The electric hydraulic actuator according to claim 8, further comprising a linkage member configured to transmit rotation of the rotating shaft to the drive gear by linking the rotating shaft and the drive gear such that relative rotation is not allowed, wherein the rotating shaft has a uniform circular cross section.

* * * * *